US005213038A

United States Patent [19]

Takahashi et al.

[11] Patent Number: 5,213,038

[45] Date of Patent: May 25, 1993

[54] PLATE EXCHANGE APPARATUS FOR ROTARY PRESS

[75] Inventors: Hiroshi Takahashi, Chiba; Tsuyoshi Takei, Ibaraki, both of Japan

[73] Assignee: Komori Corporation, Japan

[21] Appl. No.: 945,692

[22] Filed: Sep. 16, 1992

[30] Foreign Application Priority Data

Sep. 19, 1991 [JP] Japan ..... 3-266986

[51] Int. Cl.[5] ..... B41F 1/30

[52] U.S. Cl. ..... 101/410; 101/415.1

[58] Field of Search ..... 101/409, 410, 411, 415.1, 101/378

[56] References Cited

U.S. PATENT DOCUMENTS

| | | | |
|---|---|---|---|
| 4,009,659 | 1/1977 | Schneider | 101/415.1 |
| 4,104,968 | 8/1978 | Schwaab et al. | 101/415.1 |
| 4,347,788 | 9/1982 | Dufour et al. | 101/415.1 |
| 4,376,414 | 3/1983 | Burger | 101/415.1 |
| 4,493,258 | 1/1985 | Wallschlaeger et al. | 101/415.1 |
| 4,530,283 | 7/1985 | Mathes et al. | 101/410 |
| 4,890,555 | 1/1990 | Bryer et al. | 101/415.1 |
| 5,107,763 | 4/1992 | Gevis | 101/415.1 |
| 5,131,326 | 7/1992 | Wrzesinski | 101/378 |

*Primary Examiner*—Eugene H. Eickholt

*Attorney, Agent, or Firm*—Blakely, Sokoloff, Taylor & Zafman

[57] ABSTRACT

In a plate exchange apparatus for a rotary press, a plate winding rod is pivotally fitted in a winding rod hole in an outer circumferential portion of a plate cylinder and has a spring groove extending almost an entire length thereof. A plurality of leaf springs are provided in the spring groove. Each leaf spring is constituted by a leaf spring member to have a U-shaped section, and has an end formed with a press portion to urge a leading end of a plate against a surface of a gap of the plate cylinder and the other end formed with a bent portion to catch a bent end wound on a circumferential surface of the plate cylinder. A biasing member biases the plate winding rod in a predetermined rotational direction. A plate winding rod pivoting unit is coupled to an end portion of the plate winding rod by a cam mechanism. A plate press roller extends in an axial direction of the plate cylinder close to the circumferential surface of the plate cylinder, and is moved forward and backward toward and away from the leading end of the plate by a driving unit. A control unit operates the plate winding rod, the plurality of leaf springs, the biasing member, the plate winding rod pivoting unit, and the plate press roller at predetermined timings.

1 Claim, 15 Drawing Sheets

PLATE EXCHANGE APPARATUS FOR ROTARY PRESS

BACKGROUND OF THE INVENTION

The present invention relates to a plate exchange apparatus for a rotary press, which automatically removes an old plate from a plate cylinder and mounts a new plate on a plate cylinder.

In a variety of rotary presses, a winding rod hole partially open to the circumferential surface of a plate cylinder and having a circular section extends in the axial direction of the plate cylinder, and a plate winding rod is fitted in the winding rod hole. To mount a plate on the circumferential surface of the plate cylinder, the leading end of the plate is inserted in the holding portion of the winding rod, and the plate cylinder is rotated by almost one revolution to wind the plate on the circumferential surface of the plate cylinder. The trailing end of the plate is held by the holding portion of the winding rod, and the plate winding rod is rotated while regulating the reverse rotation of the plate winding rod by a ratchet device or the like. To remove the plate from the plate cylinder, an operation substantially reverse to that for mounting the plate is performed.

In a conventional plate exchange apparatus of this type, however, plate exchange must be entirely performed by manual operations to necessitate much labor, thus increasing load to the operator. In addition, plate exchange requires a long period of time to prolong the preparation time, thus degrading the operation efficiency of the machine. Also, operational safety is not sufficient.

SUMMARY OF THE INVENTION

The present invention has been made in view of the problems described above, and has as its object to provide a plate exchange apparatus for a rotary press, which enables automatic plate exchange within a short period of time without using any tools.

In order to achieve this object, according to the present invention, there is provided a plate exchange apparatus for a rotary press, comprising a plate winding rod pivotally fitted in a winding rod hole in an outer circumferential portion of a plate cylinder and having a spring groove extending almost an entire length thereof, a plurality of leaf springs, each constituted by a leaf spring member to have a U-shaped section, provided in the spring groove, and each having an end formed with a press portion for urging a leading end of a plate against a surface of a gap of the plate cylinder and the other end formed with a bent portion for catching a bent end wound on a circumferential surface of plate cylinder, a biasing member for biasing the plate winding rod in a predetermined rotational direction, a plate winding rod pivoting unit coupled to an end portion of the plate winding rod by a cam mechanism, a plate press roller extending in an axial direction of the plate cylinder close to the circumferential surface of the plate cylinder and moved forward and backward toward and away from the leading end of the plate by a driving unit, and a control unit for operating the plate winding rod, the plurality of leaf springs, the biasing member, the plate winding rod pivoting unit, and the plate press roller at predetermined timings.

When a start button and a selection button are depressed while the leaf springs are inserted in the groove of the plate winding rod and an old plate is mounted on the plate cylinder, the plate cylinder of a selected printing unit is stopped, the plate winding rod pivoting unit is actuated, and the plate winding rod is pivoted through the cam mechanism to let the trailing end of the old plate out of the leaf springs. The trailing end of the plate is held by a hand, and the plate cylinder is rotated in the reverse direction to remove the leading end of the plate from the leaf springs.

After the old plate is removed in this manner, the plate winding rod is pivoted by a push button operation through the cam mechanism to insert the leading end of a new plate under the leaf springs. The plate press roller is moved forward by a push button operation to press the plate, and the plate cylinder is rotated in the forward direction to wind the new plate on its cylinder surface. Thereafter, the trailing end of the plate is inserted under the leaf springs so that its bent end is caught by the bent end portions of the leaf springs, thus completing new plate mounting

DETAILED DESCRIPTION OF THE PREFERRED EMBODIMENT

Figure 1:
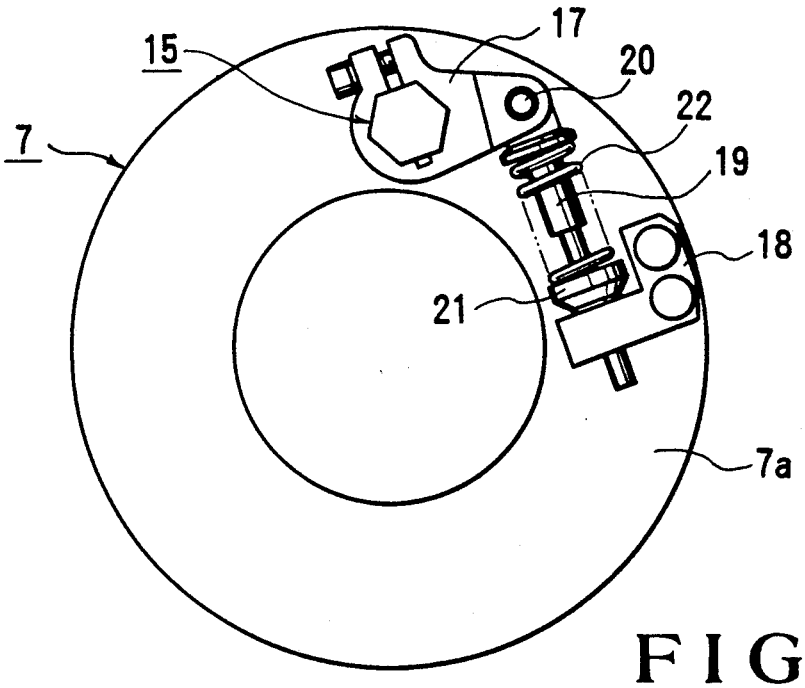
FIG. 1 is a side view of a plate cylinder.
Figure 2:
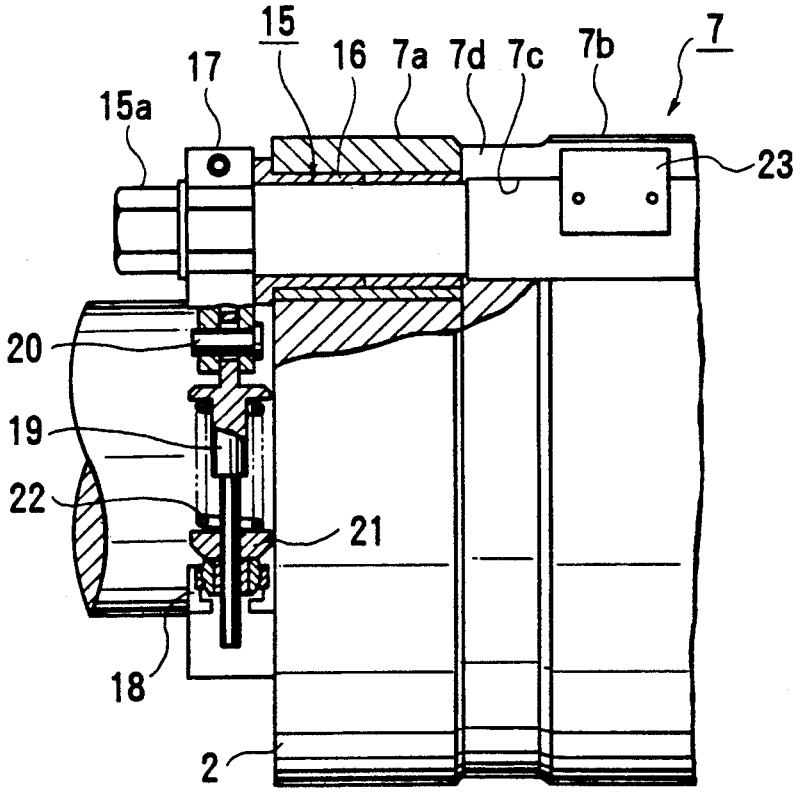
FIG. 2 is a partially cutaway front view of an end portion of the plate cylinder.
Figure 3:
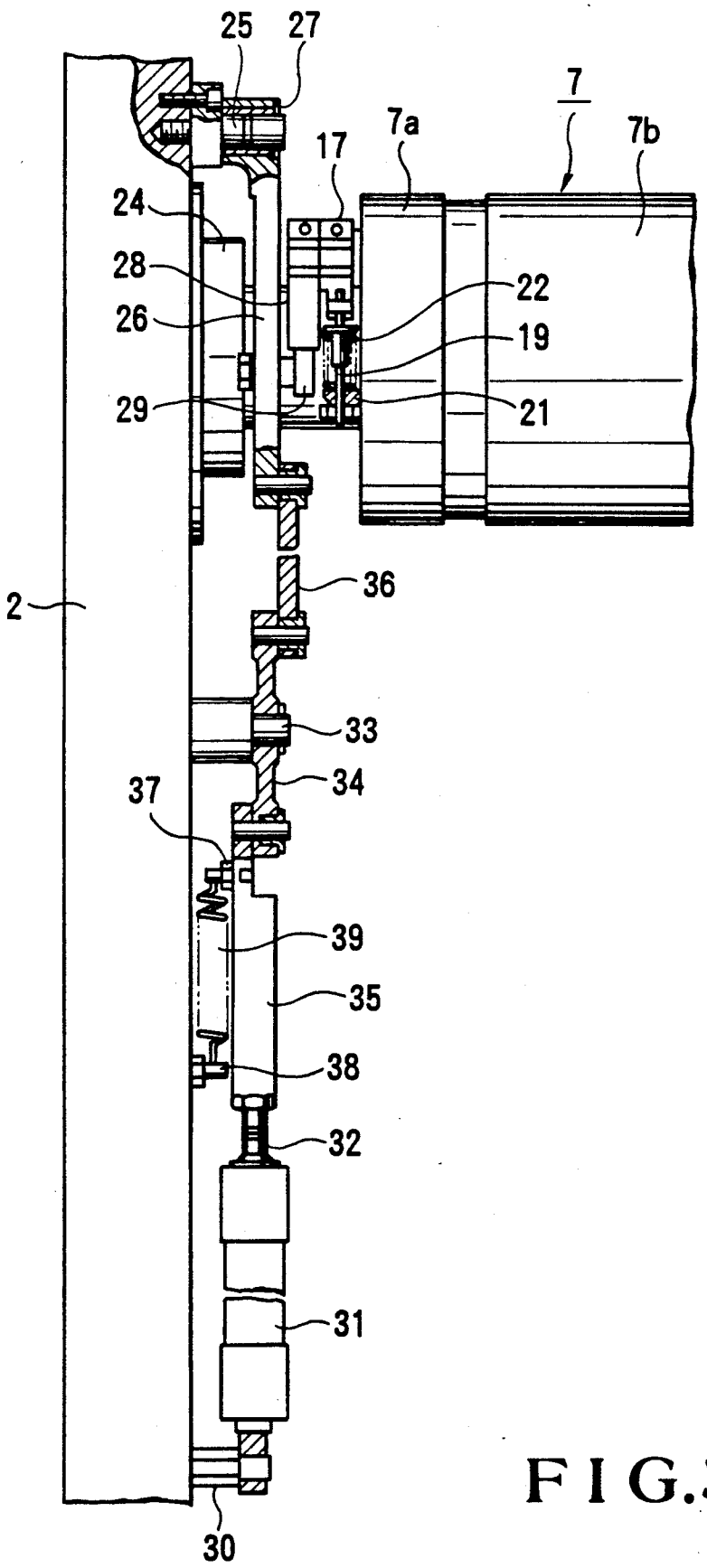
FIG. 3 is a partially cutaway developed front view of a plate winding/driving section.
Figure 4:
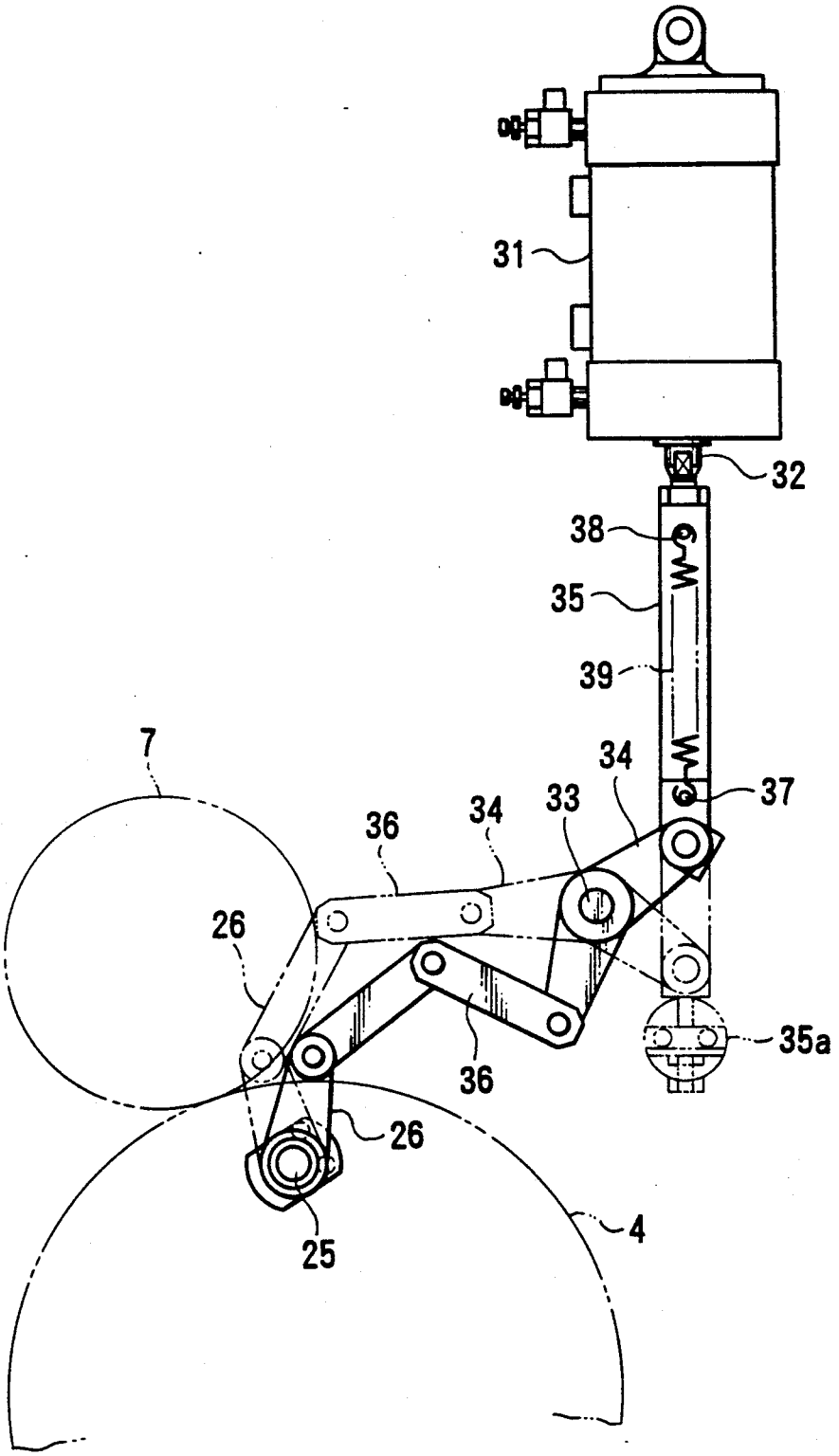
FIG. 4 is a side view of the plate winding/driving section.
Figure 5:
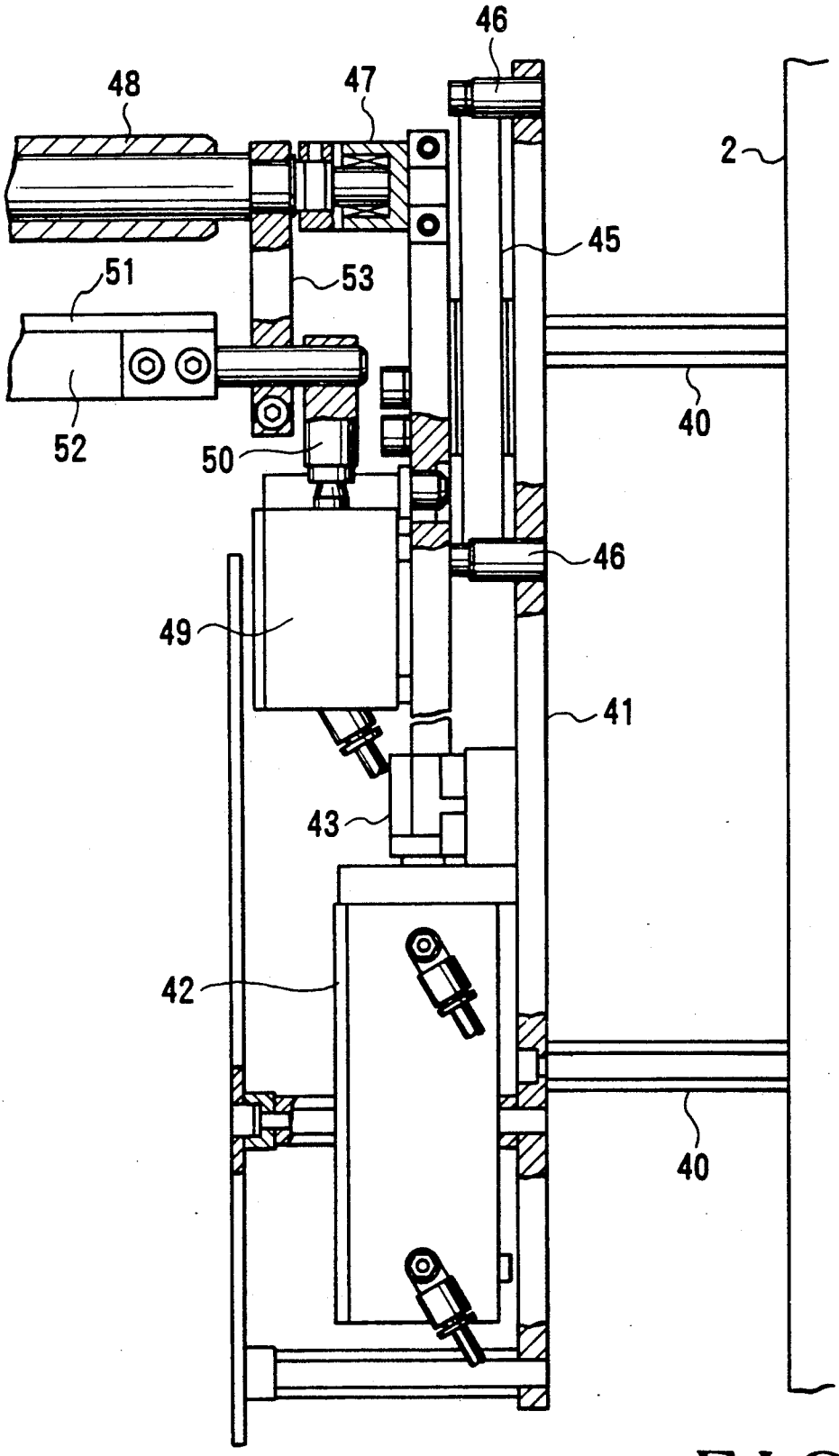
FIG. 5 is a front view of a plate press section.
Figure 6:
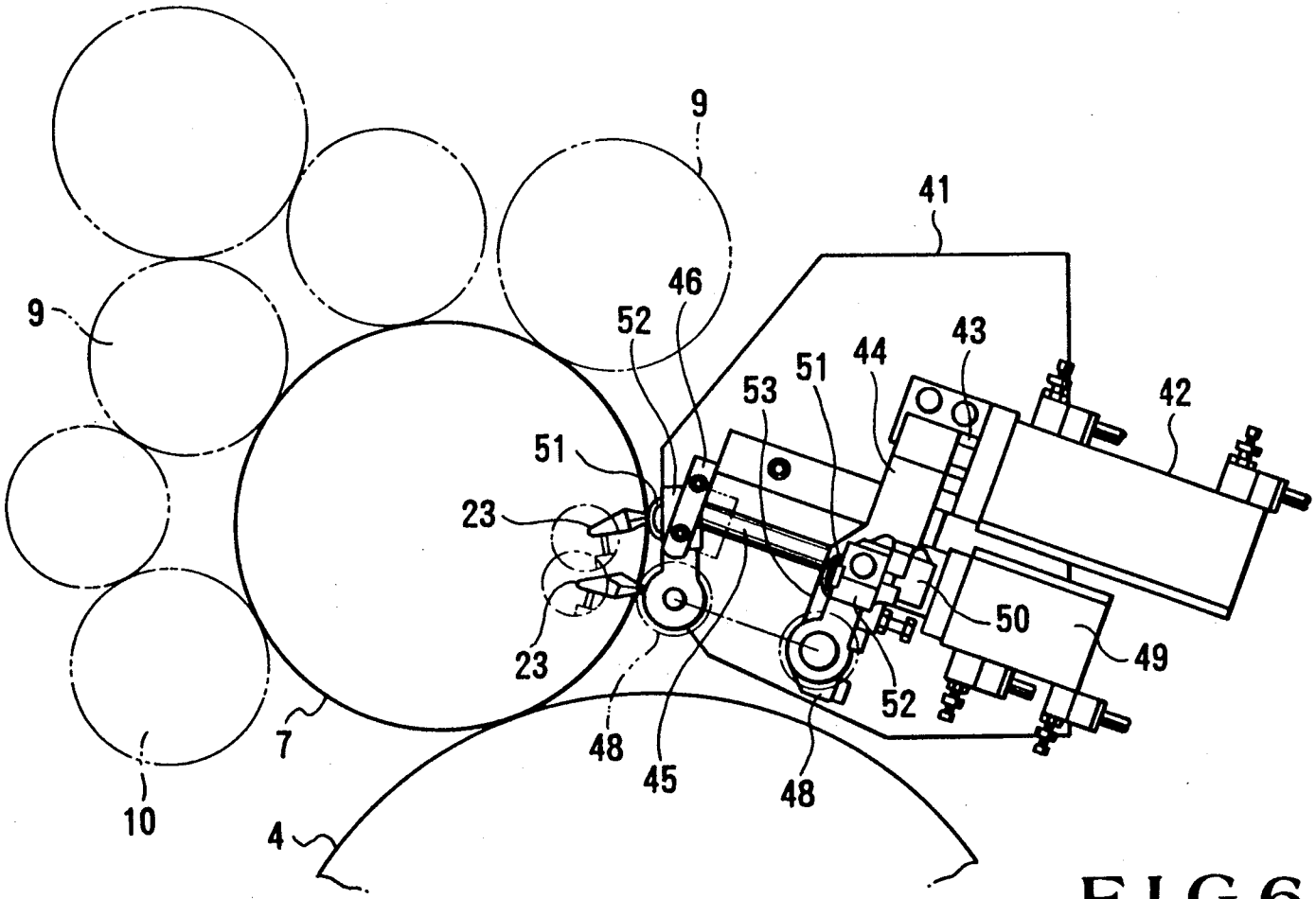
FIG. 6 is a side view of the plate press section.
Figure 7:
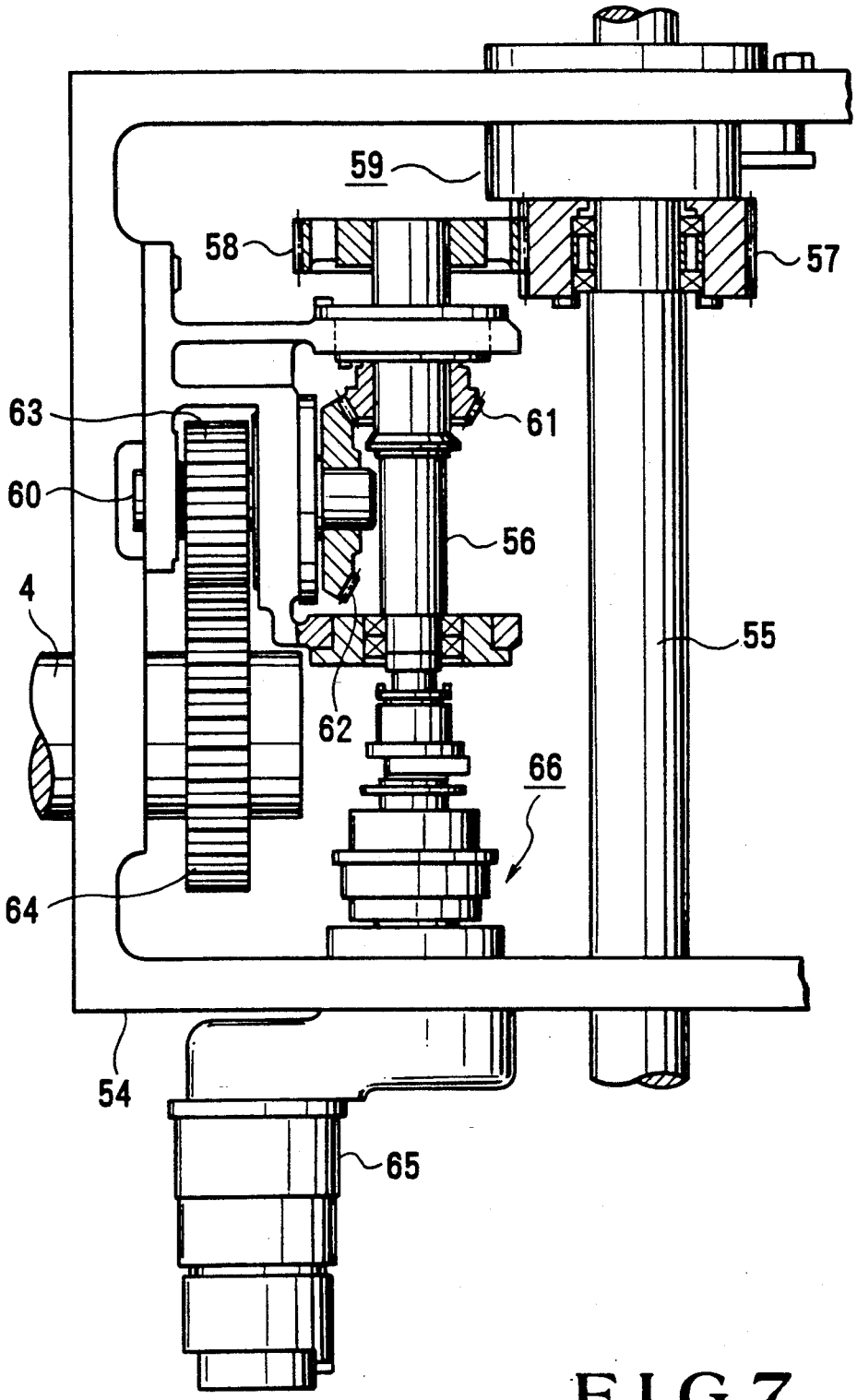
FIG. 7 is a partially cutaway plan view of a printing unit single-acting driving section.
Figure 8:
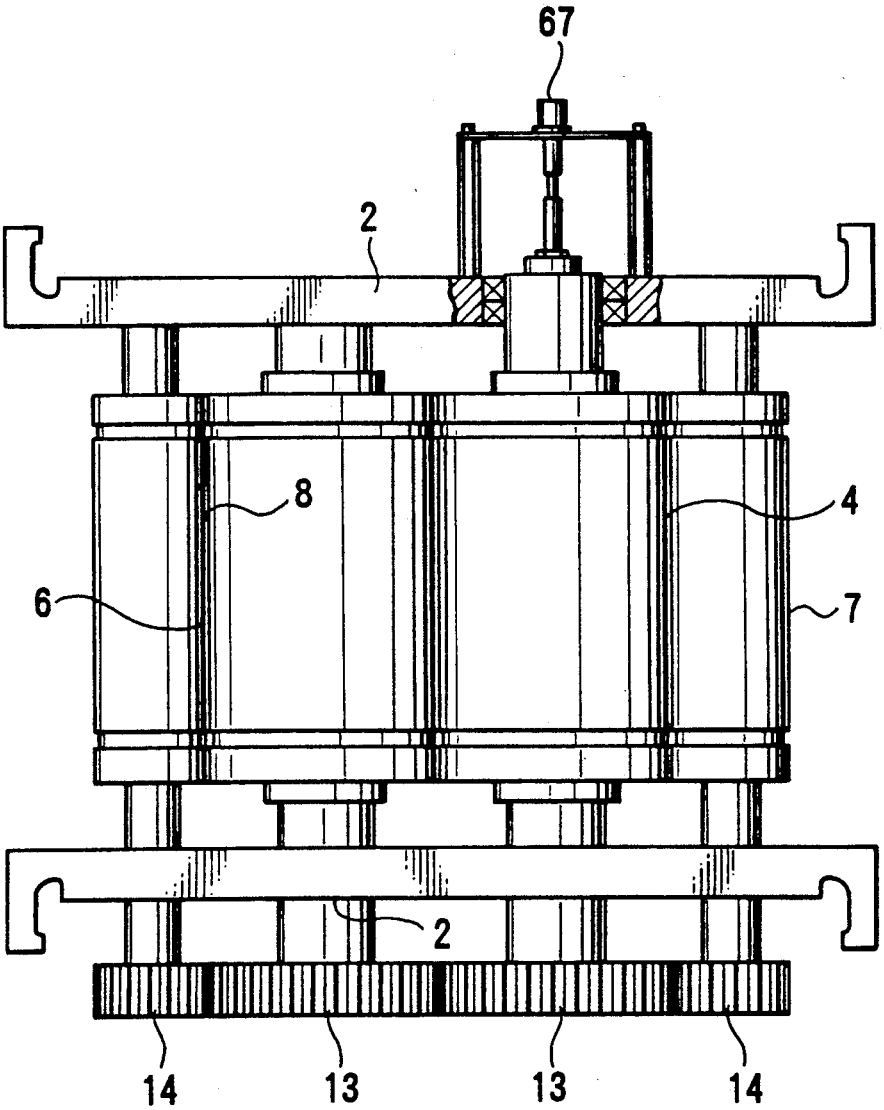
FIG. 8 is a developed plan view of the printing unit single-acting driving section.
Figure 9:
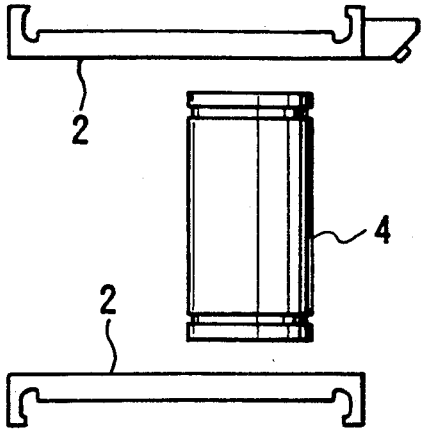
FIG. 9 is a schematic plan view of a printing unit.
Figure 10:
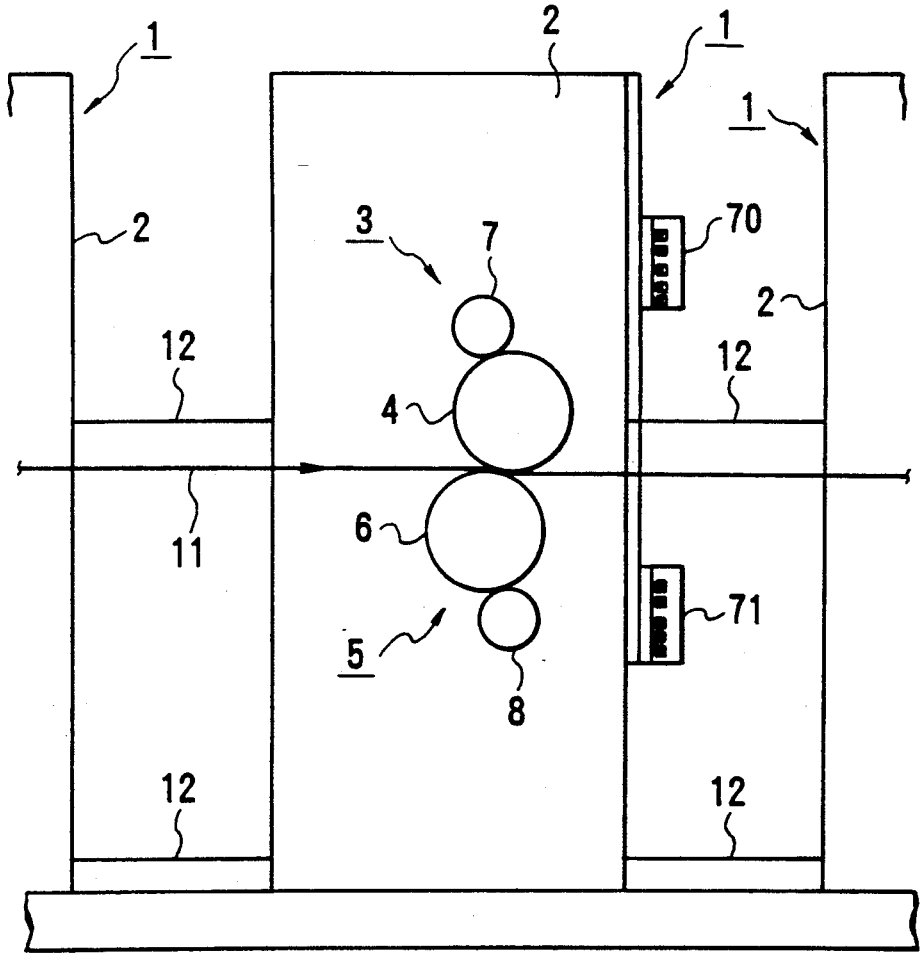
FIG. 10 is a schematic front view of the printing unit.
Figure 16:
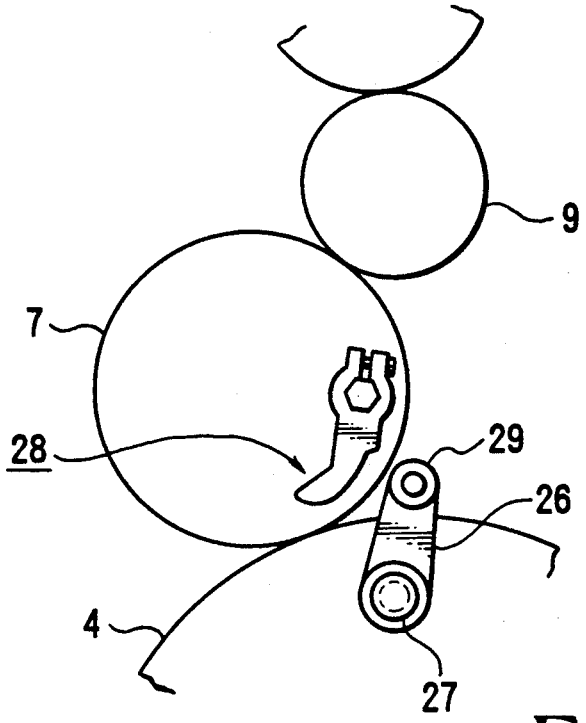
FIG. 16 is a side view of an end portion of the plate cylinder and its vicinity to describe the plate winding operation.
Figure 17:
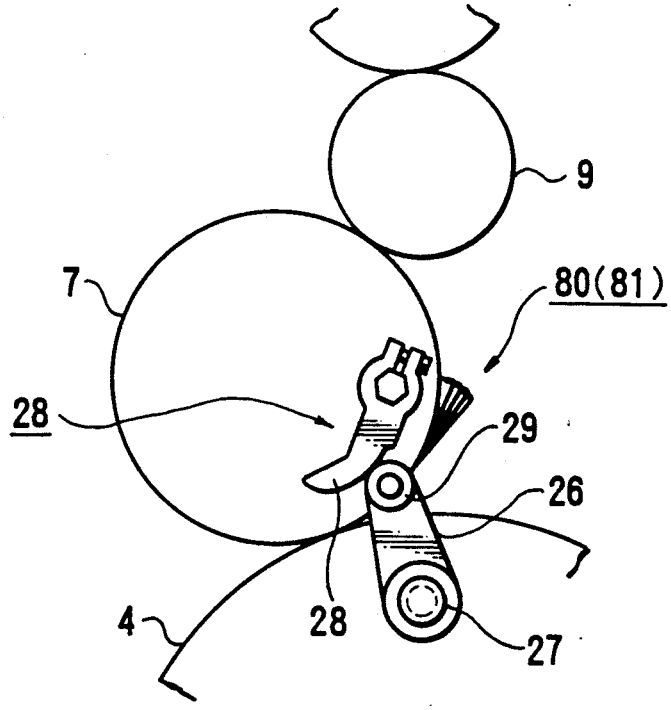
FIG. 17 is a side view of the end portion of the plate cylinder and its vicinity to describe the plate winding operation.
Figure 18:
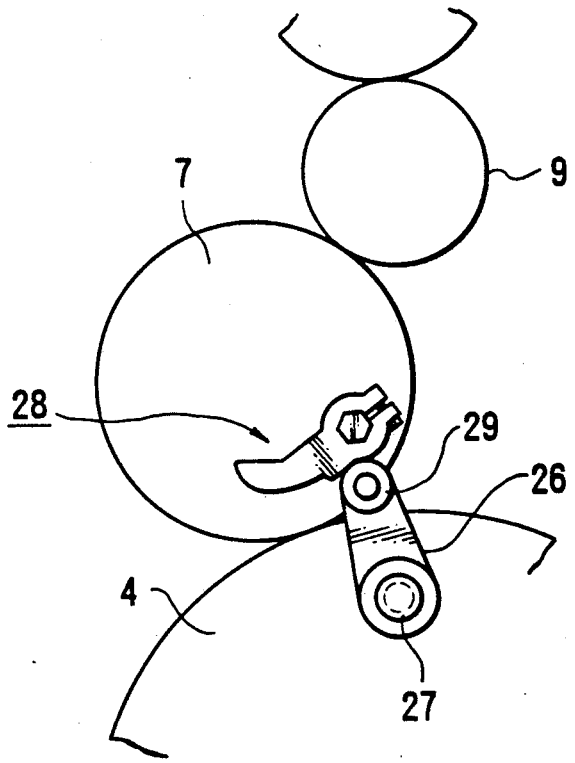
FIG. 18 is a side view of the end portion of the plate cylinder and its vicinity to describe the plate winding operation.
Figure 19:
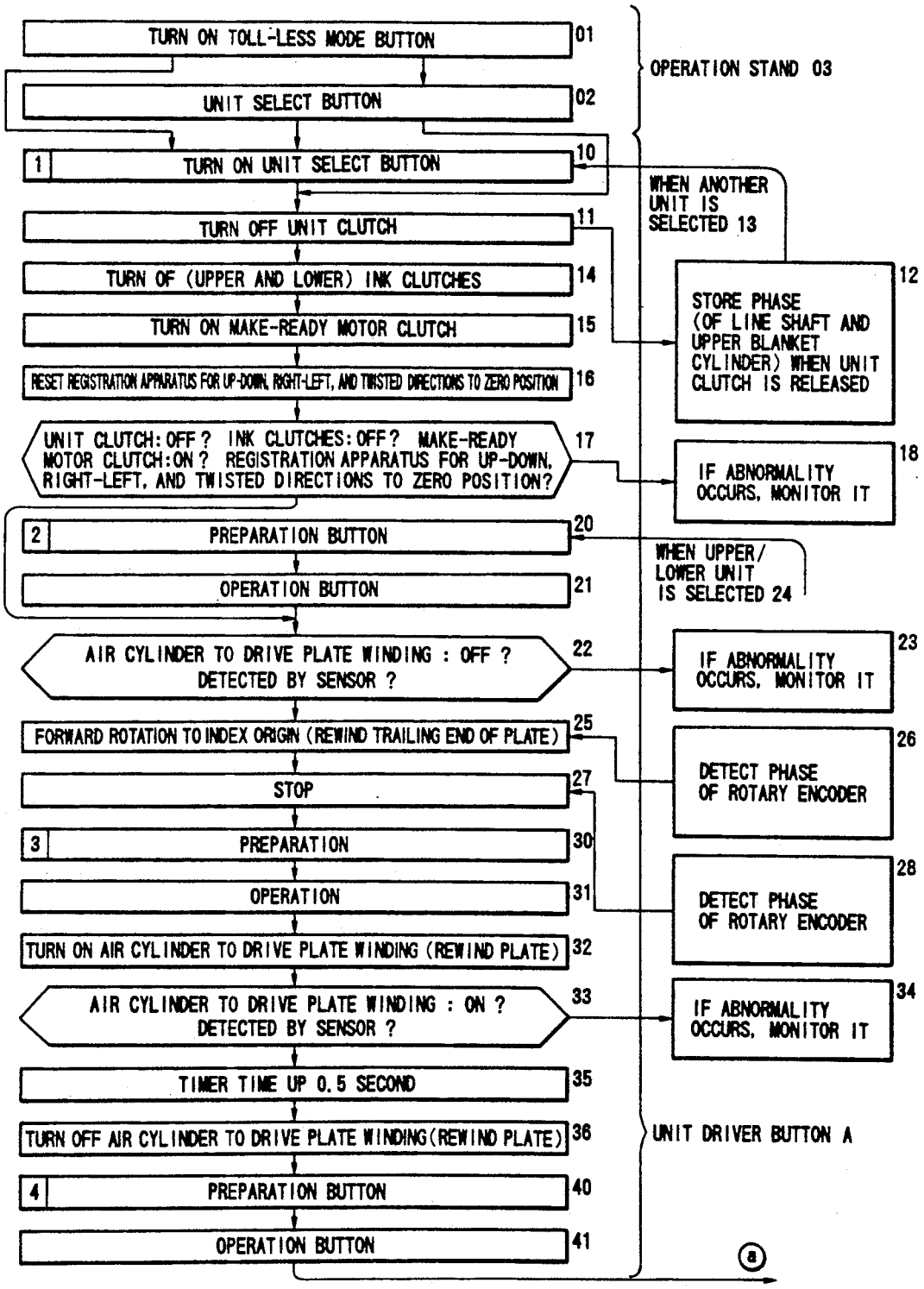
FIG. 19 is a flow chart of a plate exchange operation.
Figure 20:
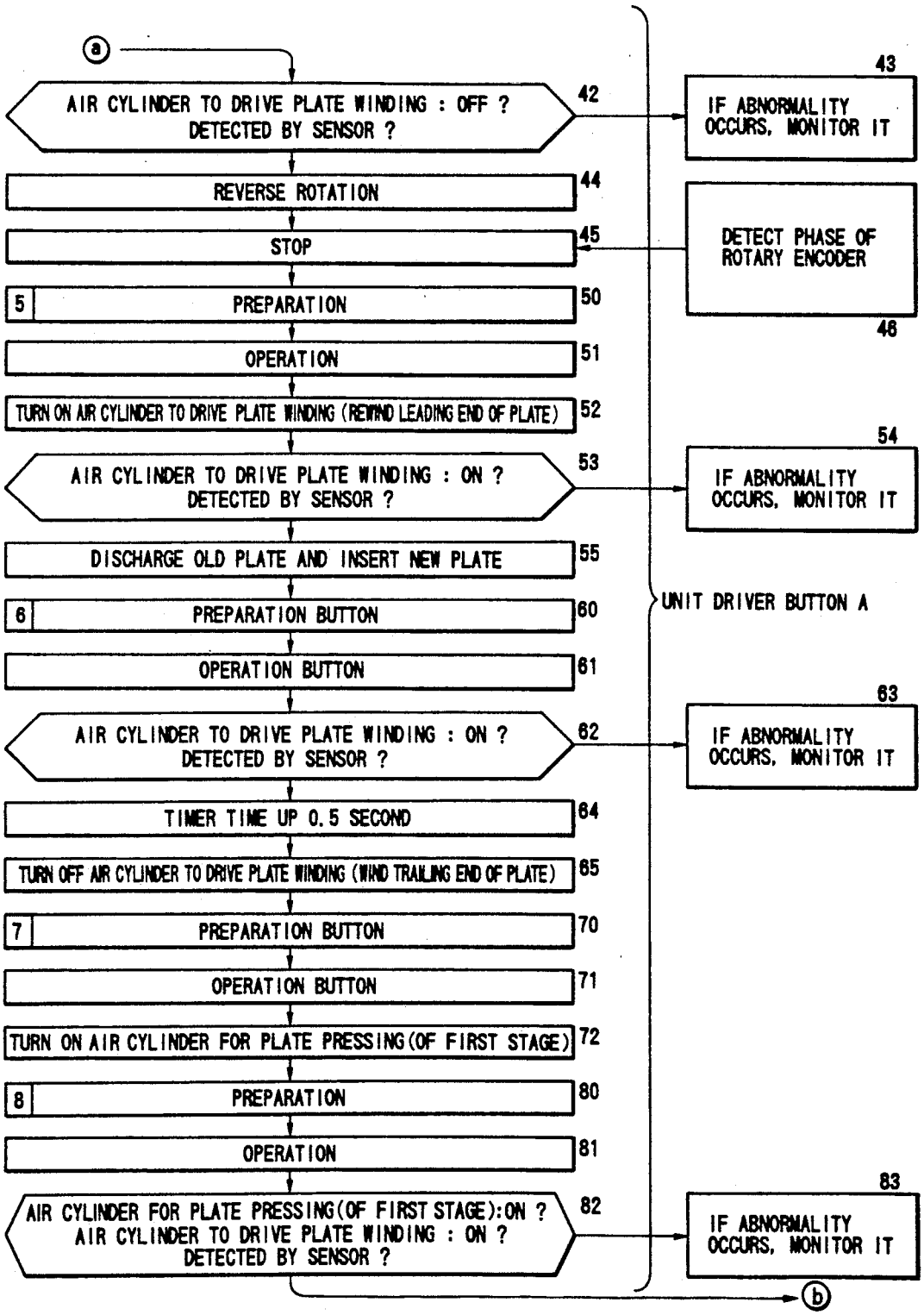
FIG. 20 is a flow chart of the plate exchange operation.
Figure 21:
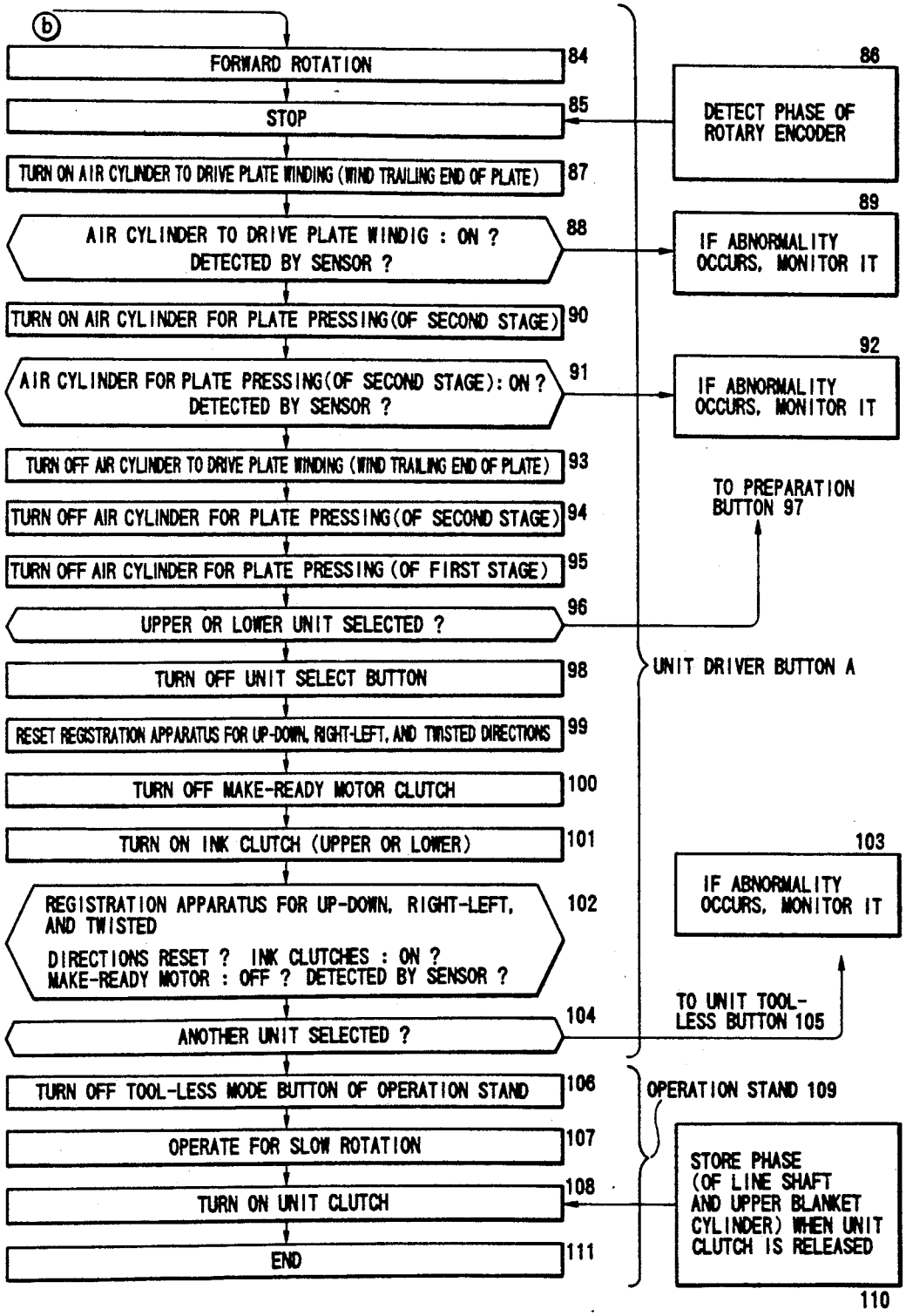
FIG. 21 is a flow chart of the plate exchange operation.

FIGS. 1 to 18 show an arrangement in which a plate exchange apparatus for a rotary press according to the present invention is applied to a perfecting web rotary press, in which FIG. 1 shows a plate cylinder, FIG. 2 shows an end portion of the plate cylinder, FIGS. 3 and 4 show a plate winding/driving section, FIGS. 5 and 6 show a plate press section, FIGS. 7 and 8 show a printing unit single-acting section, FIGS. 9 and 10 show a printing unit, FIGS. 11 to 15 show a plate winding rod and its vicinity to describe a plate winding operation, and FIGS. 16 to 18 show an end portion of the plate cylinder and its vicinity to describe the plate winding operation. FIGS. 19 to 21 show a plate exchange operation.

Referring to FIGS. 8 to 10, a blanket cylinder 4 of an upper printing device 3 and a blanket cylinder 6 of a lower printing device 5 are axially supported to extend between right and left frames 2 of a printing unit 1 to be in contact with each other. Plate cylinders 7 and 8 axially supported by the right and left frames 2 contact the blanket cylinders 4 and 6, respectively. Plates are mounted on the circumferential surfaces of the plate cylinders 7 and 8 by a plate exchange apparatus (to be described later) according to the present invention. The lower printing device 5 has substantially the same arrangement as that of the upper printing device 3, and hence only the upper printing device 3 will be described hereinafter. A plurality of ink rollers 9 of an inking arrangement shown in FIG. 6 contact the surface of the plate mounted on the plate cylinder 7, and a form dampening roller 10 of a dampening arrangement contacts the surface of the plate. Images formed on the plate surfaces with ink and water supplied to the plate surface from the inking and dampening arrangements only partly shown in FIG. 6 are transferred to the blanket cylinders 4 and 6, and to a web 11 traveling in a direction indicated by an arrow in FIG. 10, thus performing double-sided printing Reference numerals 12 denote steps provided between adjacent printing units 1. The operator stands on each step 12 to perform plate exchange, ink exchange, or the like. Reference numerals 13 and 14 denote cylinder gears for transmitting rotation of a driver to the blanket cylinders 4 and 6 and the plate cylinders 7 and 8.

Referring to FIGS. 1 and 2, disk-like bearers 7*a* are integrally formed on the two end portions of the plate cylinder 7, and a winding rod hole 7*c* extends in the circumferential portion of a cylinder body 7*b* throughout the entire length of the plate cylinder 7 between the bearers 7*a*. A plate winding rod 15 sightly longer than the length of the plate cylinder 7 and having a section of a true circle is pivotally fitted in the winding rod hole 7*c*. The movement of the plate winding rod 15 in the axial direction is regulated by abutting its stepped portions against bushes 16 fitted in corresponding portions of the bearers 7*a* of the winding rod hole 7*c*. A projecting portion 15*a* of the plate winding rod 15 on the operation side of the machine base has a hexagonal section, and a lever 17 is fixed on the projecting portion 15*a* by split clamping such that its hexagonal hole is fitted on the projecting portion 15*a*.

Figure 11:
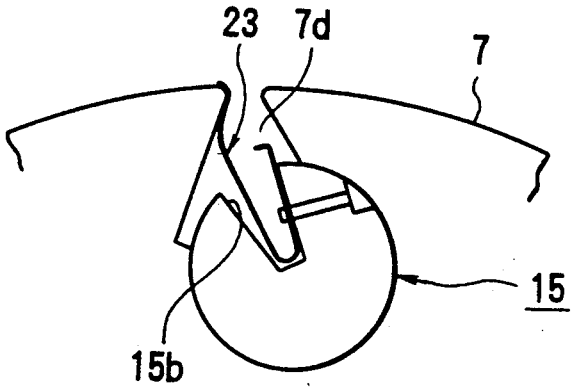
FIG. 11 is a front view of the plate winding rod and its vicinity to describe a plate winding operation.

An L-shaped bracket 18 is bolted to the end face of the bearer 7*a* close to the lever 17. A spring shaft 19 having a flange is pivotally fixed to the branching portion formed on the free end portion of the lever 17 by a pin 20. The spring shaft 19 is slidably fitted in holes respectively formed in a spring seat 21 and the bracket 18. Reference numeral 22 denotes a compression coil spring disposed between the flange of the spring shaft 19 and the spring seat 21 to pivot the plate winding rod 15 counterclockwise in FIG. 1 through the lever 17. As shown in FIG. 11, a groove 15*b* is formed in the plate winding rod 15 to extend in the radial direction of the plate winding rod 15 and open to the circumferential surface of the plate winding rod 15 throughout the entire length of the plate winding rod 15. A plurality of U-shaped leaf springs 23 each having a small width and used for plate winding (to be described later) are urged into the groove 15*b*. The plate winding rod 15 stops as the spring force of the compression coil spring 22 and that of the leaf springs 23 are balanced. A gap 7*d* corresponding to the winding rod hole 7*c* is formed in the circumferential surface of the plate cylinder 7 to be open to its circumferential surface.

Referring to FIGS. 3 and 4, the plate cylinder 7 is axially supported on the frame 2 through a bearing 24, and a pin 25 having a flange is fixed above the bearing 24 by threadably engaging its threaded portion in the screw hole in the frame 2. A V-shaped lever 26 is pivotally supported on the pin 25 while it is prevented from being disengaged from the pin 25 by its bush 27. A cam lever 28 is fixed to the other projecting portion 15*a* of the plate winding rod 15 by split clamping, and a cam follower 29 pivotally mounted on the central portion of the lever 26 contacts the free end portion of the cam lever 28.

An air cylinder 31 is pivotally supported on a pin 30 provided to the frame 2. The operating end of a piston rod 32 which moves forward and backward by the air pressure of the air cylinder 31 and one free end portion of a V-shaped link 34 pivotally supported by a stud 33 provided to the frame 2 are coupled to each other by a link 35 having two ends pivotally supported by pins. The lever 26 and the other free end portion of the link 34 are coupled to each other by a link 36 having two ends pivotally supported by pins. A tension coil spring 39 to rotate the lever 26 to a position indicated by a long and two short dashed line in FIG. 4 when a power failure occurs. Reference numeral 35*a* denotes a stopper fixed to the frame 2 to regulate the moving limit of the link 35 when the link 35 is abutted against it.

Referring to FIGS. 5 and 6, substantially square sub frames 51 are provided inside the two frames 2 in the vicinity of the circumferential surface of the plate cylinder 7 as they are supported by a plurality of posts 40. An air cylinder 42 is fixed to each sub frame 41. A lever 44 perpendicular to a piston rod 43 of the air cylinder 42 and extending toward substantially the axis of the blanket cylinder 4 is coupled to the operating end of the piston rod 43. Reference numeral 45 denotes a slide shaft having two ends supported by brackets 46 of each sub frame 41 and extending in a direction perpendicular to the lever 44. The lever 44 is slidably fitted on the slide shaft 45. When the piston rod 43 is moved forward and backward by the air pressure, the lever 44 is guided by the slide shaft 45 to move forward and backward toward and away from the circumferential surface of the plate cylinder 7. A bearing 47 is mounted on each distal end portion of the lever 44 of each sub frame 41. Two end portions of a plate press roller 48 extending in the axial direction of the plate cylinder 7 are axially rotatably supported by the bearings 47 on the two sides. When the plate press roller 48 is moved forward, it is brought into tight contact with the plate surface on the plate cylinder 7.

Another air cylinder 49 is fixed to each lever 44 such that its axial direction is parallel with that of the corresponding air cylinder 42. The air cylinders 49 move forward and backward together with the corresponding levers 44. A pad 51 made of an elastic material, e.g., rubber, and extending in the axial direction of the plate press roller 48 is provided to the operating end of a piston rod 50 as the pad 51 is supported by a bar 52. The piston rods 50 are moved forward and backward by the air pressure of the corresponding air cylinders 49. The free end portion of each lever 53 having a base portion pivotally loosely mounted on the end shaft of the plate press roller 48 is loosely mounted on the end shaft of the bar 52. When the piston rods 50 are moved forward, the levers 53 swing about the end shaft of the plate press roller 48, and the pads 51 on the free end portions of the levers 53 are rotated to be urged against the trailing end of the plate in the radial direction. More specifically, when the plate press roller 48 is moved forward by the air cylinders 42 and urged against the plate surface, if the piston rods 50 of the air cylinders 49 are moved forward, the pads 51 are rotated to be urged against the trailing end of the plate at portions each having a different phase in the circumferential direction of the plate cylinder 7 from the portion urged by the plate press roller 48.

The arrangement of the printing unit driving section will be described with reference to FIG. 7. In a gear box 54 provided to the driver of the printing unit 1, a line shaft 55, driven by the driver and extending along the machine base, and an intermediate shaft 56 parallel with the line shaft 55 axially extend and are coupled to each other by gears 57 and 58. A solenoid clutch 59 is interposed between the gear 57 and the line shaft 55 to be connected to and disconnected from them by a signal from a control unit or a push button operation. The intermediate shaft 56 and a gear shaft 60 perpendicular to it are coupled by bevel gears 61 and 62, and the gear shaft 60 and the blanket cylinder 4 are coupled to each other by gears 63 and 64.

A single-acting motor 65 is mounted to the gear box 54, and a clutch 66 for connecting and disconnecting rotary transmission between the single-acting motor 65 and the intermediate shaft 56 is provided to the intermediate shaft 56. More specifically, during printing, the intermediate shaft 56 is driven by the driver when the solenoid clutch 59 and the clutch 66 are connected and disconnected, respectively, so that the line shaft 55 is driven by the driver motor. For plate exchange, the intermediate shaft 56 is driven by the single-acting motor 65 when the solenoid clutch 59 and the clutch 66 are disconnected and connected, respectively. Referring to FIG. 8, a rotary encoder 67 is mounted in the end shaft of the upper blanket cylinder 4 opposite to the gears 13 and 14 to detect a stop position of the plate cylinder 7.

Referring to FIG. 10, operation panels 70 and 71 are provided to the upper and lower printing devices 3 and 5 and fixed to the frame 2 on the side of the operation space, and push buttons for operating the respective devices and units described above are provided to the operation panels 70 and 71. Each printing unit 1 has a sequencer of its own.

The operation of the plate exchange apparatus having the arrangement as described above will be described with reference to the views of FIGS. 11 to 18 describing the plate winding operation and the flow charts of FIGS. 19 and 21. The leaf springs 23 are urged in the groove **15*b* of the plate winding rod 15, and an old plate 81 is mounted on the plate cylinder 7 in the same manner as in a new plate 80 shown in FIG. 15. More specifically, a leading end 81*a* of the old plate 81 bent by a plate bending machine (not shown) is inserted in the gap 7*d* of the plate cylinder 7 to be held on the wall surface of the gap 7*d* by one end of each leaf spring 23, and a trailing end 81*d* of the old plate 81 bent by the plate bending machine at almost a right angle is held on the bent portion of the other end of each leaf spring 23** to be caught by it.

When the old plate is mounted in this manner, a plate exchange mode button of the operation stand is depressed to set the driver motor in a non-operative safe state, and a unit select button is depressed. Then, the solenoid clutch 59 (unit clutch) of the driver of the upper printing unit 3 of the selected printing unit 1 is disconnected, the clutch (make-ready clutch) 66 of the single-acting motor 65 is connected, and an ink clutch (not shown) is disconnected, thus resetting the printing registration apparatus for the up-down, right-left, and twisted directions to the zero position. Since the single-acting motor 65 is rotated in this state, the plate cylinder 7 is rotated to a position indicated in FIG. 12 and stopped.

Figure 14:
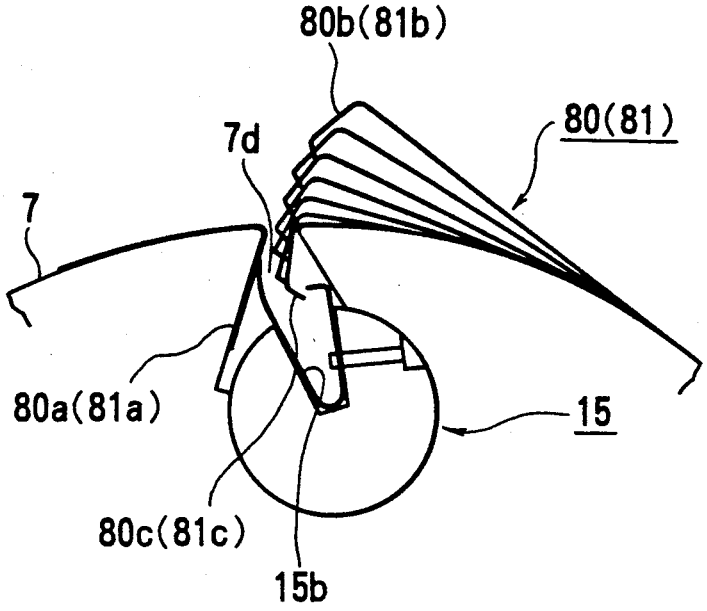
FIG. 14 is a front view of the plate winding rod and its vicinity to describe the plate winding operation.
Figure 15:
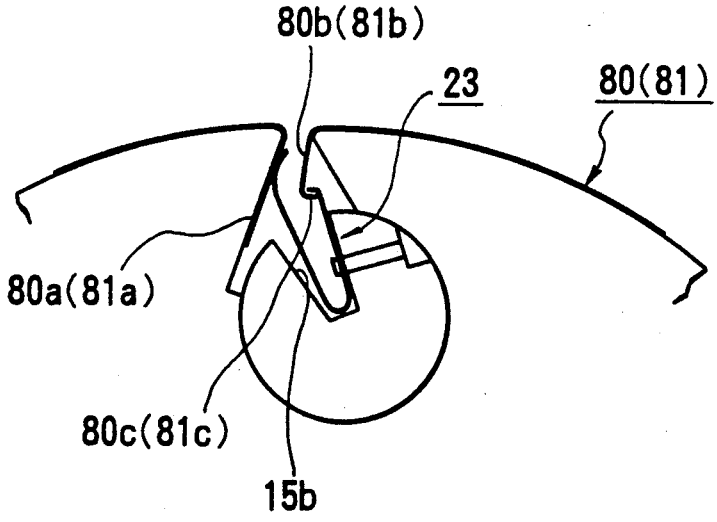
FIG. 15 is a front view of the plate winding rod and its vicinity to describe the plate winding operation.

In this state, when a preparation/operation button is depressed, the air cylinder 31 is actuated, the cam follower 29 pivotally supported on the lever 26 urges the cam lever 28 to pivot the plate winding rod 15, as shown in FIG. 17, and the bent portions of the leaf springs 23 release the old plate 81, as shown in FIG. 14. Hence, the trailing-side bent portion of the old plate 81 is let out of the plate cylinder 7. When the trailing end of the plate 81 is held by a hand and the preparation/operation button is depressed, the plate cylinder 7 is rotated in the reverse direction to rewind the old plate 81, and is stopped at the position shown in FIG. 18.

Figure 12:
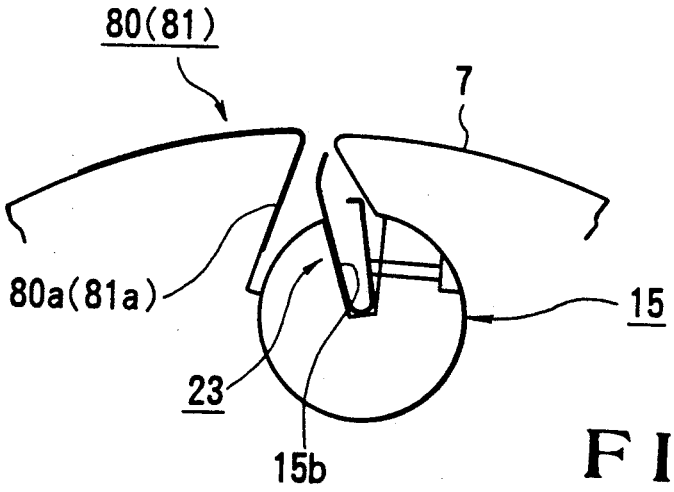
FIG. 12 is a front view of the plate winding rod and its vicinity to describe the plate winding operation.

Then, when the preparation/operation button is depressed, the air cylinder 31 is actuated so that the cam follower 29 pivotally mounted on the lever 26 urges the cam lever 28 to rotate and stop the plate winding rod 15 to and at the position shown in FIG. 12. The leading end of the old plate 81 is released from the leaf springs 23 and is let out of the plate cylinder 7, thus completing removal of the old plate 81.

Figure 13:
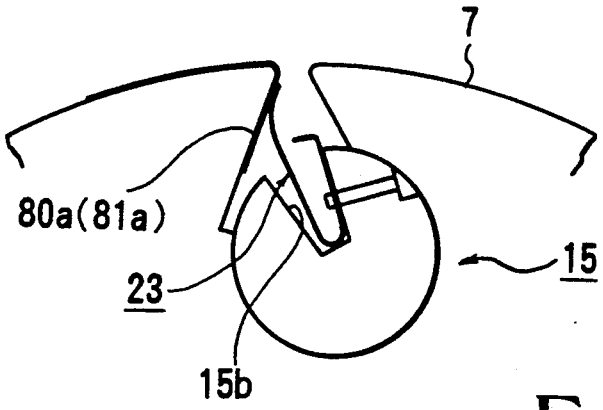
FIG. 13 is a front view of the plate winding rod and its vicinity to describe the plate winding operation.

In this state, when a leading end **80*a* of the new plate 80 is inserted in the gap of the blanket cylinder 4, as shown in FIG. 12, and the preparation/operation button is depressed, the air cylinder 31 is actuated so that the cam follower 29 pivotally mounted on the lever 26 releases the cam lever 28, and the plate winding rod 15 is rotated to and stopped at the position shown in FIG. 13 by the spring force of the compression coil spring 22. Hence, the leading end 80*a* of the new plate 80 is held by the leaf spring 23. When the preparation/operation button is depressed, the plate cylinder 7 is rotated in the forward direction to wind the new plate 80 on the circumferential surface of the plate cylinder 7, and the plate cylinder 7 is stopped at the position shown in FIG. 17. When the new plate 80 is to be wound on the circumferential surface of the plate cylinder 7, the air cylinders 42 was actuated to move the piston rods 43 forward, and the levers 44 are moved together with the pads 51 as they are guided by the slide shafts 45. Hence, the plate press roller 48 is urged against the surface of the new plate 80. Since the new plate 80 is wound on the plate cylinder 7 in this manner, it is in tight contact with the circumferential surface of the plate cylinder 7**.

When the rotation of the plate cylinder 7 is stopped, the air cylinders 49 are actuated to move their piston rods 50 forward. Then, the levers 53 are pivoted about the end shaft of the plate press roller 48 to rotate the pads 51 fixed to their free end portions to be urged against the trailing-side bent portion of the new plate 80 in the radial direction. Thus, the trailing-side bent portion of the new plate 80 is inserted under the open end portions of the leaf springs 23. At this time, the plate winding rod 15 is pivoted by the air cylinders 42 to the position shown in FIG. 15. Thus, a trailing-side end portion 80*b* of the new plate 80 is held as its bent end 80*c* is caught by the bent portions of the leaf springs 23, thus complete mounting of the new plate 80. After this, plate exchange of the lower printing device 5 and plate exchange of other printing units are performed in accordance with the same operation as that described above. Clutch exchange is performed, and the plate exchange mode button is canceled.

In the above embodiment, a separate device is used to insert the trailing-side bent portion of the plate under the open end portions of the leaf springs 23. However, the position of the plate press roller 48 may be altered and used to insert the trailing-side bent portion of the plate.

As is apparent from the above description, according to the present invention, the plurality of leaf springs each constituted by a leaf spring member and having a U-shaped section are provided in a spring groove of the plate winding rod which is pivotally fitted in the winding rod hole of the plate cylinder and capable of being pivoted by a plate winding rod pivoting device, and the two ends of the plate mounted on the plate cylinder are held by the leaf springs. The plate press roller and the elastic pards are provided. The plate press roller extends in the axial direction of the plate cylinder close to the circumferential surface of the plate cylinder and is moved forward and backward toward and away from the leading end of the plate by a driving unit. The elastic pads extend in the axial direction of the plate cylinder close to the circumferential surface of the plate cylinder and are moved forward and backward toward and away from the trailing end of the plate by the driving unit. The respective devices and units are operated at predetermined timings by the control unit. Hence, the plate exchange operation can be performed by a single operator within a short period of time without using any tool to decrease labor and energy consumption, thereby shortening the preparation time and increasing the operation efficiency of the machine.

What is claimed is:

1. A plate exchange apparatus for a rotary press, comprising:

a plate winding rod pivotally fitted in a winding rod hold in an outer circumferential portion of a plate cylinder and having a spring groove extending almost an entire length thereof;

a plurality of leaf springs, each constituted by a leaf spring member to have a U-shaped section, provided in the spring groove, and each having an end formed with a press portion for urging a leading end of a plate against a surface of a gap of said plate cylinder and the other end formed with a bent portion for catching a bent end wound on a circumferential surface of plate cylinder;

a biasing member for biasing said plate winding rod in a predetermined rotational direction;

a plate winding rod pivoting unit coupled to an end portion of said plate winding rod by a cam mechanism;

a plate press roller extending in an axial direction of said plate cylinder close to said circumferential surface of said plate cylinder and moved forward and backward toward and away from the leading end of the plate by a driving unit; and a control unit for operating said plate winding rod, said plurality of leaf springs, said biasing member, said plate winding rod pivoting unit, and said plate press roller at predetermined timings.

* * * * *